US008899268B2

(12) United States Patent
Garner et al.

(10) Patent No.: US 8,899,268 B2
(45) Date of Patent: Dec. 2, 2014

(54) DISCHARGE ARM ASSEMBLY FOR PUMPING UNITS

(75) Inventors: William H. Garner, Houston, TX (US); Alan R. Killingsworth, The Woodlands, TX (US); David M. Oskins, Tomball, TX (US); Paul A. Crawford, Houston, TX (US); Tep Ungchusri, The Woodlands, TX (US)

(73) Assignee: FMC Technologies, Inc., Houston, TX (US)

( * ) Notice: Subject to any disclaimer, the term of this patent is extended or adjusted under 35 U.S.C. 154(b) by 788 days.

(21) Appl. No.: 12/653,316

(22) Filed: Dec. 10, 2009

(65) Prior Publication Data

US 2010/0193057 A1 Aug. 5, 2010

Related U.S. Application Data

(60) Provisional application No. 61/201,609, filed on Dec. 11, 2008.

(51) Int. Cl.
*F16L 27/00* (2006.01)
*E21B 33/13* (2006.01)

(52) U.S. Cl.
CPC ..... *E21B 33/13* (2013.01)
USPC ..... 137/615; 137/351; 285/147.1

(58) Field of Classification Search
USPC ..... 137/615, 276, 277, 279, 616, 616.3, 137/616.5, 616.7, 315, 899, 351; 285/62, 285/147.1, 147.3
See application file for complete search history.

(56) References Cited

U.S. PATENT DOCUMENTS

| | | | | | |
|---|---|---|---|---|---|
| 829,609 | A | * | 8/1906 | Steinke | 137/313 |
| 1,085,973 | A | * | 2/1914 | Conkling | 222/409 |
| 1,654,300 | A | * | 12/1927 | McGee et al. | 137/615 |
| 2,770,475 | A | | 11/1956 | Rafferty | |
| 3,114,392 | A | | 12/1963 | Harper | |
| 3,126,913 | A | | 3/1964 | Green et al. | |
| 3,176,730 | A | | 4/1965 | Knight | |
| 3,199,898 | A | | 8/1965 | Faccou | |
| 3,724,499 | A | | 4/1973 | Huniu | |
| 3,753,453 | A | | 8/1973 | Madden et al. | |
| 4,029,126 | A | | 6/1977 | Miyazaki et al. | |
| 4,037,667 | A | * | 7/1977 | Gonsalves et al. | 172/14 |
| 4,099,542 | A | | 7/1978 | Gibbons | |
| 4,130,134 | A | | 12/1978 | Castle | |
| 4,202,372 | A | | 5/1980 | Gibbons | |
| 4,570,673 | A | | 2/1986 | Kendrick et al. | |
| 4,828,033 | A | | 5/1989 | Frison | |
| 4,998,560 | A | * | 3/1991 | Le Devehat | 137/616 |

(Continued)

*Primary Examiner* — Craig Schneider
*Assistant Examiner* — Jonathan Waddy
(74) *Attorney, Agent, or Firm* — Henry C. Query, Jr.

(57) ABSTRACT

A discharge arm assembly for a truck or trailer-mounted pumping unit comprises a jumper line which is connected to the outlet of the pumping unit, a base unit which is connected to the outlet of the jumper line, and an articulated arm which is connected to the outlet of the base unit. The base unit includes a base conduit which is rigidly secured to the truck or trailer and a swivel arm which is rotatable about a generally vertical axis. The articulated arm comprises a first generally straight pipe which is connected to the swivel arm by a generally 90° elbow. A brace member comprises a first end which is connected to the swivel arm and a second end which is connected to the first pipe to thereby support the first pipe for movement in a generally horizontal plane.

9 Claims, 3 Drawing Sheets

(56) References Cited

U.S. PATENT DOCUMENTS

| | | | | |
|---|---|---|---|---|
| 5,758,687 | A * | 6/1998 | Funicello | 137/615 |
| 6,220,292 | B1 * | 4/2001 | Woodling et al. | 137/615 |
| 6,230,805 | B1 | 5/2001 | Vercaemer et al. | |
| 6,701,980 | B2 | 3/2004 | Rothrock | |
| 6,823,888 | B1 * | 11/2004 | Raymond | 137/351 |
| 7,207,389 | B2 | 4/2007 | Foster et al. | |
| 7,635,254 | B2 | 12/2009 | Kunz et al. | |
| 2006/0011242 | A1 | 1/2006 | Meyerinck | |
| 2006/0054244 | A1 * | 3/2006 | Meyerinck | 141/387 |
| 2007/0277881 | A1 * | 12/2007 | Fugel | 137/351 |
| 2009/0120635 | A1 | 5/2009 | Neal | |
| 2014/0060685 | A1 * | 3/2014 | Roth et al. | 137/615 |

* cited by examiner

DISCHARGE ARM ASSEMBLY FOR PUMPING UNITS

The present application is based on and claims priority from U.S. Provisional Patent Application No. 61/201,609, which was filed on Dec. 11, 2008.

BACKGROUND OF THE INVENTION

The present invention is directed to a discharge pipe assembly for truck and trailer mounted high pressure well service pumping units. More specifically, the invention is directed to a discharge arm assembly comprising an articulated arm which is mounted to the truck or trailer bed and is connected to a fixed jumper line that in turn is connected to the pumping unit.

High pressure well service pumping units are commonly used in the hydrocarbon production industry to inject a variety of fluids into an oil or gas well during certain well servicing operations. For example, during a fracturing operation such pumping units are used to inject a particle-containing slurry into the well in order to fracture the hydrocarbon bearing formation and thereby produce channels within the formation through which the oil or gas may flow.

Typical fracturing operations require the use of several pumping units operating in unison to inject a large volume of slurry into the well. The pumping units are mounted on respective trucks or trailers which are parked close together, and the discharge pipe assembly of each pumping unit is connected to a collection manifold which in turn is connected to a wellhead at the top of the well.

The connection between each pumping unit and the collection manifold is usually made using a temporary flow line comprising a collection of individual and pre-assembled pipes and swivel joints secured together by clamps or connectors. The flow line components are stowed on the truck or trailer in compact configurations, and when the truck or trailer reaches the job site, they must be unfolded, assembled and the clamps or connectors rigged-up in order to extend the flow line to the collection manifold. However, this operation is time consuming, especially when multiple pumping units must be connected to the collection manifold. Also, in order to provide adequate support for the flow line, a common practice is to run the flow line from the truck or trailer to the ground and then from the ground to the collection manifold. However, this requires that each flow line be made up of several swivel joints comprising multiple swivel connections. In addition, the parts of the flow line which rest on the ground can experience undue wear that may shorten the life of these components. Furthermore, the numerous components of the many flow lines create cramped and cluttered conditions in the area between the pumping units and the collection manifold, which can be a safety hazard for persons assembling the flow lines.

SUMMARY OF THE INVENTION

According to the present invention, these and other limitations in the prior art are addressed by providing a discharge arm assembly which includes a jumper line that is connected to an articulated arm via a base unit. The base unit comprises a conduit, such as a swivel joint, which is rigidly secured to the trailer and which provides for fluid communication between the jumper line and the articulated arm. The jumper line may comprise any combination of generally straight pipes and/or swivel joints which are sufficient to span the distance between the base swivel joint and the outlet pipe assembly of the pumping unit. In addition, the jumper line may include enough swivel joints to isolate the base unit, and thus the articulated arm, from vibration and movement of the pumping unit. The articulated arm is supported on the base unit and preferably comprises two or more generally straight pipes which are connected together by swivel joints to allow the arm to expand in a scissor-like fashion.

Ideally, the discharge arm assembly comprises no more swivel joints than are required to ensure that the necessary degrees of freedom are present between the pumping unit and the collection manifold. In addition, since the articulated arm is supported by the base unit, none of the swivel joints is required to rest on the ground. This greatly reduces the clutter in the area between the pumping unit and the collection manifold and eliminates undue wear in the swivel joints.

The discharge arm assembly may include a spring or pressure cylinder to balance the articulated arm and thereby resist the tendency of the arm to fall. This cylinder is optimally designed such that one person can manipulate the articulated arm while making the connection at the collection manifold. This, along with having to make only one connection, results in a significant labor reduction over existing practices in the prior art.

These and other objects and advantages of the present invention will be made apparent from the following detailed description, with reference to the accompanying drawings. In the drawings, the same reference numbers are used to denote similar components in the various embodiments.

DETAILED DESCRIPTION OF THE INVENTION

Figure 1:
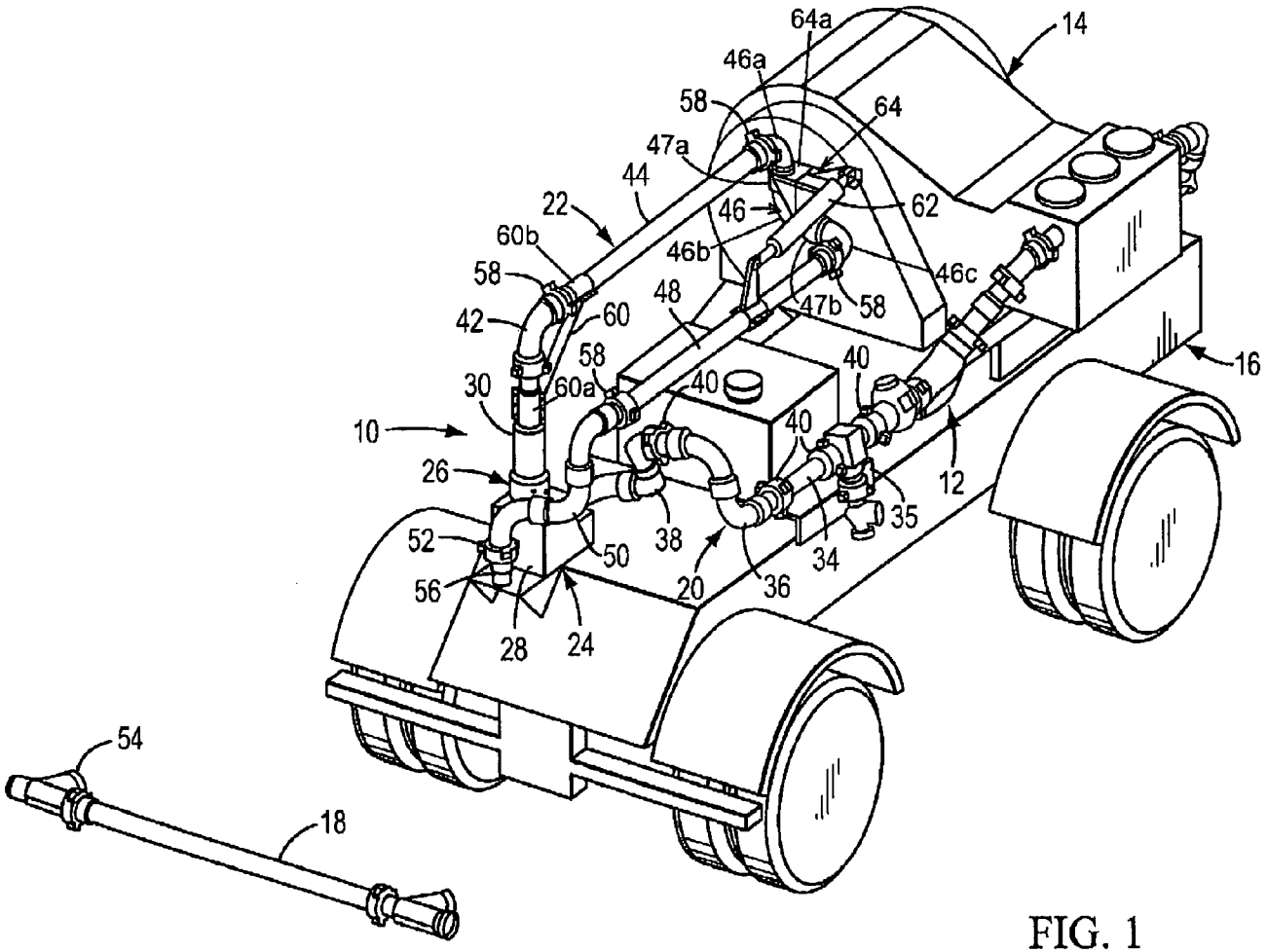
FIG. 1 is a perspective view of the discharge arm assembly of the present invention shown connected to an exemplary well service pumping unit which is mounted on a truck trailer.
Figure 2:
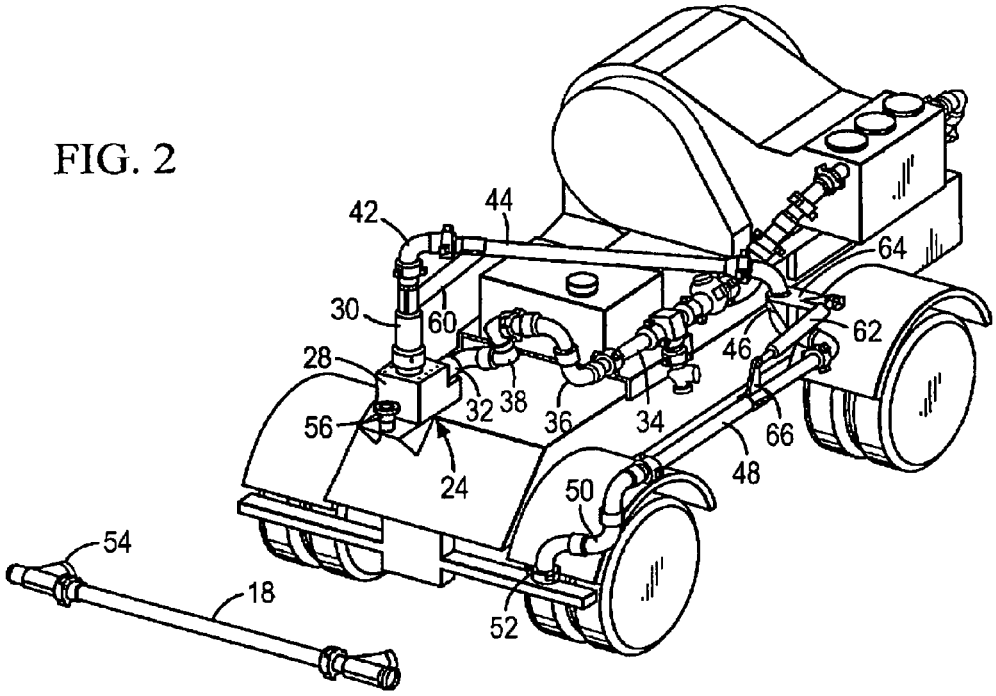
FIGS. 2 and 3 are perspective views similar to FIG. 1 but showing the articulated arm portion of the discharge arm assembly being extended for connection to a collection manifold.
Figure 3:
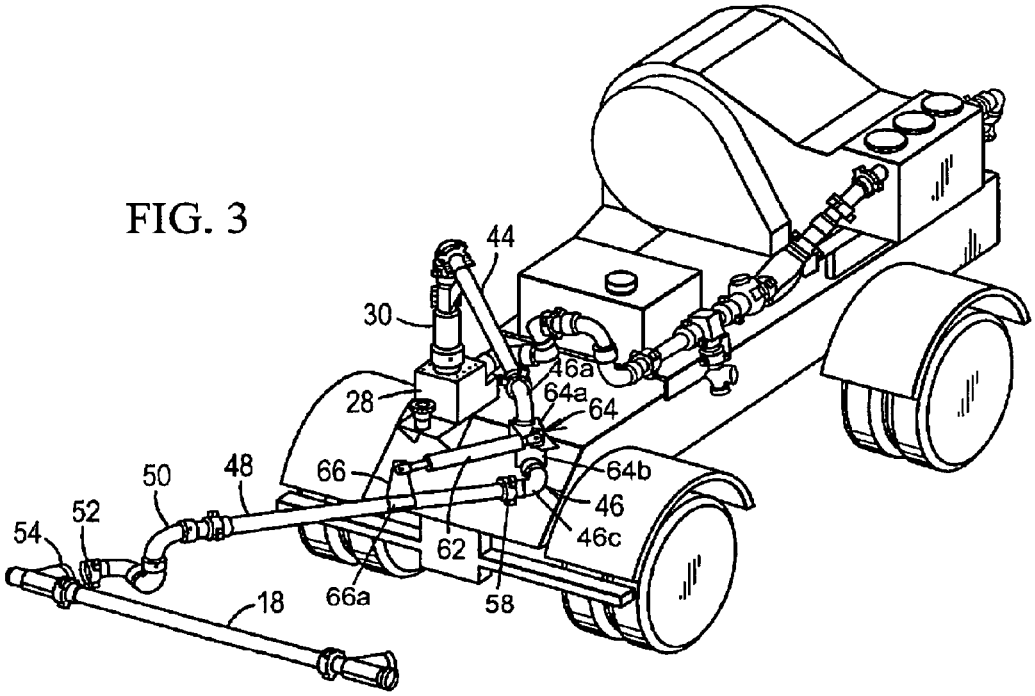

Referring to FIGS. 1 through 3, the discharge arm assembly of the present invention, which is indicated generally by reference number 10, is shown connected to the discharge pipe assembly 12 of a well service pumping unit 14 that is mounted on a trailer 16. The trailer 16 is shown parked in the vicinity of a collection manifold 18 which is connected to a well (not shown). The discharge arm assembly 10 is used to connect the pump discharge pipe assembly 12 to the collection manifold 18 during well service operations.

The discharge arm assembly 10, which in FIG. 1 is shown in its stowed position on the trailer 16, includes a jumper line 20 which is connected to an articulated arm 22 via a base unit 24. The base unit 24 comprises a base conduit 26 which is rigidly secured to the trailer 16 and which provides for fluid communication between the jumper line 20 and the articulated arm 22. In the exemplary embodiment of the invention shown in FIG. 1, the base conduit 26 comprises a swivel joint which is bolted to a frame member 28 that in turn is secured such as by welding to the bed of the trailer 16. In this configuration, the base swivel joint 26 includes an upper arm 30 which is rotatable about a vertical axis and a lower arm 32 which is fixed relative to the frame member 28. As shown in FIG. 1, the base unit 24 may be positioned off center relative to the trailer 16 to ensure that the discharge arm assembly 10 does not extend over the side of the trailer when articulated from its stowed position.

The jumper line 20 may comprise any combination of generally straight pipes and/or swivel joints which are sufficient to span the distance between the base swivel joint 26 and the outlet pipe assembly 12 of the pumping unit 14. In a preferred embodiment of the invention, the jumper line 20 includes enough swivel joints to isolate the base unit 24, and thus the articulated arm 22, from vibration and movement of the pumping unit 14. As shown in FIG. 1, for example, the jumper line 20 may comprise a first generally straight pipe 34 which is connected to an optional diverter valve 35 that in turn is connected the discharge pipe assembly 12. A first swivel joint 36 is connected to the first pipe 34, and a second swivel joint 38 is connected between the first swivel joint and the lower arm 32 of the base swivel joint 26. These connections may be made by any suitable means. For example, the diverter valve 35, the first pipe 34, the first swivel joint 36, the second swivel joint 38 and the lower arm 32 may be connected together, and the diverter valve may be connected to the discharge pipe assembly 12, using corresponding threaded couplings 40, such as the Weco® brand wing unions which are available from FMC Technologies, Inc. of Houston, Tex.

In this embodiment of the invention, the first swivel joint 36 comprises two swivel connections and the second swivel joint 38 comprises three swivel connections. Accordingly, the first and second swivel joints 36, 38 provide five degrees of freedom between the first pipe 34 and the base swivel 26. As a result, the base unit 24 will not be affected by vibration and movement of the pumping unit 14.

The articulated arm 22 comprises a 90° elbow 42 which is connected to the upper arm 30 of the base swivel joint 26, a second generally straight pipe 44 which is connected to the 90° elbow, an apex swivel joint 46 which is connected to the second pipe, a third generally straight pipe 48 which is connected to the apex swivel joint, and an outlet swivel joint 50 which is connected to the third pipe. The outlet swivel joint 50 includes a suitable end coupling 52 for connecting the swivel joint to a corresponding coupling 54 on the collection manifold 18. In addition, the base unit 24 may be provided with a female sub 56 to which the end coupling 52 is connected when the discharge arm assembly 10 is in its stowed position.

As with the jumper line 20, the components of the articulated arm 22 may be connected together by any suitable means. For example, the upper arm 30, the 90° elbow 42, the second pipe 44, the apex swivel joint 46, the third pipe 48 and the outlet swivel joint 50 may be connected together using corresponding threaded couplings 58, such as Weco® wing unions.

In this embodiment of the invention, the second pipe 44 extends generally laterally from the upper arm 30 of the base swivel joint 26. Accordingly, the second pipe 44 is free to rotate generally horizontally relative to the base unit 24. Also, since the apex swivel joint 46 comprises two swivel connections, the third pipe 48 is free to rotate both horizontally and vertically relative to the second pipe 44. In addition, since the outlet swivel joint 50 comprises three swivel connections, the end coupling 52 may rotate in three planes relative to the third pipe 48. Consequently, the discharge arm assembly 10 provides considerably flexibility when attempting to connect the end coupling 52 to the corresponding coupling 54 on the collection manifold 18.

As shown most clearly in FIGS. 2 and 3, the discharge arm assembly 10 may include means to support the second pipe 44 in a generally horizontal position. Such means may comprise, for example, a brace 60 which is connected between the second pipe 44 and the upper arm 30 of the base unit 24. Since the upper arm 30 is rotatable about a vertical axis, the brace 60 will maintain the second pipe 44 level while allowing it to rotate in a generally horizontal plane. Referring again to FIG. 1, the brace 60 ideally also includes a first clamp 60*a* which is bolted to the upper arm 30 of the base unit 24 and a second clamp 60*b* which is bolted to the second pipe 44. By these means, the torque generated on the second pipe 44 due to the offset weight of the apex swivel joint 46, the third pipe 48 and the outlet swivel ioint 50 will be transferred through the second clamp 60*b* and the brace 60 to the upper arm 30 and thereby prevent the coupling 58 between the second pipe and the elbow 42 from becoming loose during use or transport of the discharge arm assembly, while at the same time the bolted connection of the second clamp 60*b* will permit the second pipe to be removed for repair or replacement.

In addition, the discharge arm assembly 10 may include means for balancing the third pipe 48 as it is being manipulated between its stowed and deployed positions. Referring still to FIGS. 1 through 3, this balancing means may comprise a spring, hydraulic or gas cylinder 62 which is connected between, for example, the apex swivel joint 46 and the third pipe 48. In particular, the cylinder end of the cylinder 62 may be pivotally connected to a first bracket 64 which is attached to the apex swivel joint 46, and the piston end of the cylinder may be pivotally connected to a second bracket 66 which is attached to the third pipe 48. In the embodiment of the invention shown in the drawings, the apex swivel joint 46 includes first, second and third generally 90° elbows 46*a*, 46*b*, 46*c*and first and second swivels 47*a*, 47*b* which are positioned between the first and second elbows and the second and third elbows, respectively. As shown best in FIG. 4, in this case the first bracket 64 may include a first portion 64*a* which is secured to the first swivel 47*a* and a second portion 64*b* which is secured to the second elbow 46*b*. Since the apex swivel joint 46 is vertically supported by the second pipe 44, the cylinder 62 will balance the weight of the third arm 48 and the outlet swivel joint 50 as the third arm rotates in a vertical plane. The cylinder 62 will thus reduce the effort required to raise and lower the outlet swivel 50 as the discharge arm assembly 10 is being deployed or stowed. As shown in FIG. 3, the second bracket 66 includes a clamp 66a which is bolted to the third pipe 48. As a result, the torque generated on the third pipe 48 due to the offset weight of the outlet swivel joint 50 will be transferred through the clamp 66*a*, the second bracket 66, the cylinder 62 and the first bracket 64 to the apex swivel joint 46 and thereby prevent the coupling 58 between the third pipe and the apex swivel joint from coming loose during use or transport of the discharge arm assembly, while at the same time the bolted connection of the clamp 66*a* will permit the third pipe to be removed for repair or replacement.

In one embodiment of the present invention, the first through third pipes may comprise pup joints having integrated Weco® wing union end connections and the swivel joints may comprise the particular swivel joint models listed in Table 1 below, which are available from FMC Technologies, Inc. of Houston, Texas.

TABLE 1

| Swivel Joint | Model |
|---|---|
| Base Swivel Joint 26 | Chiksan ® Style 30 Swivel Joint |
| First Swivel Joint 36 | Chiksan ® Style 10 Swivel Joint |
| Second Swivel Joint 38 | Chiksan ® Style 80 Swivel Joint |
| Apex Swivel Joint 46 | Chiksan ® Style 70 Swivel Joint |
| Outlet Swivel Joint 50 | Chiksan ® Style 80 Swivel Joint |

In operation of the discharge arm assembly 10, the end coupling 52 is disconnected from the female sub 56 and the outlet swivel joint 50 is guided toward the collection manifold 18. The base swivel joint 26 and the apex swivel joint 46 will allow the second and third pipes 44, 48 to separate and extend as the outlet swivel joint 50 is brought toward the coupling 54. Once the end coupling 52 is proximate the coupling 54, the outlet swivel joint 50 will allow the end coupling to be easily aligned so that this connection can be quickly made up.

Figure 4:
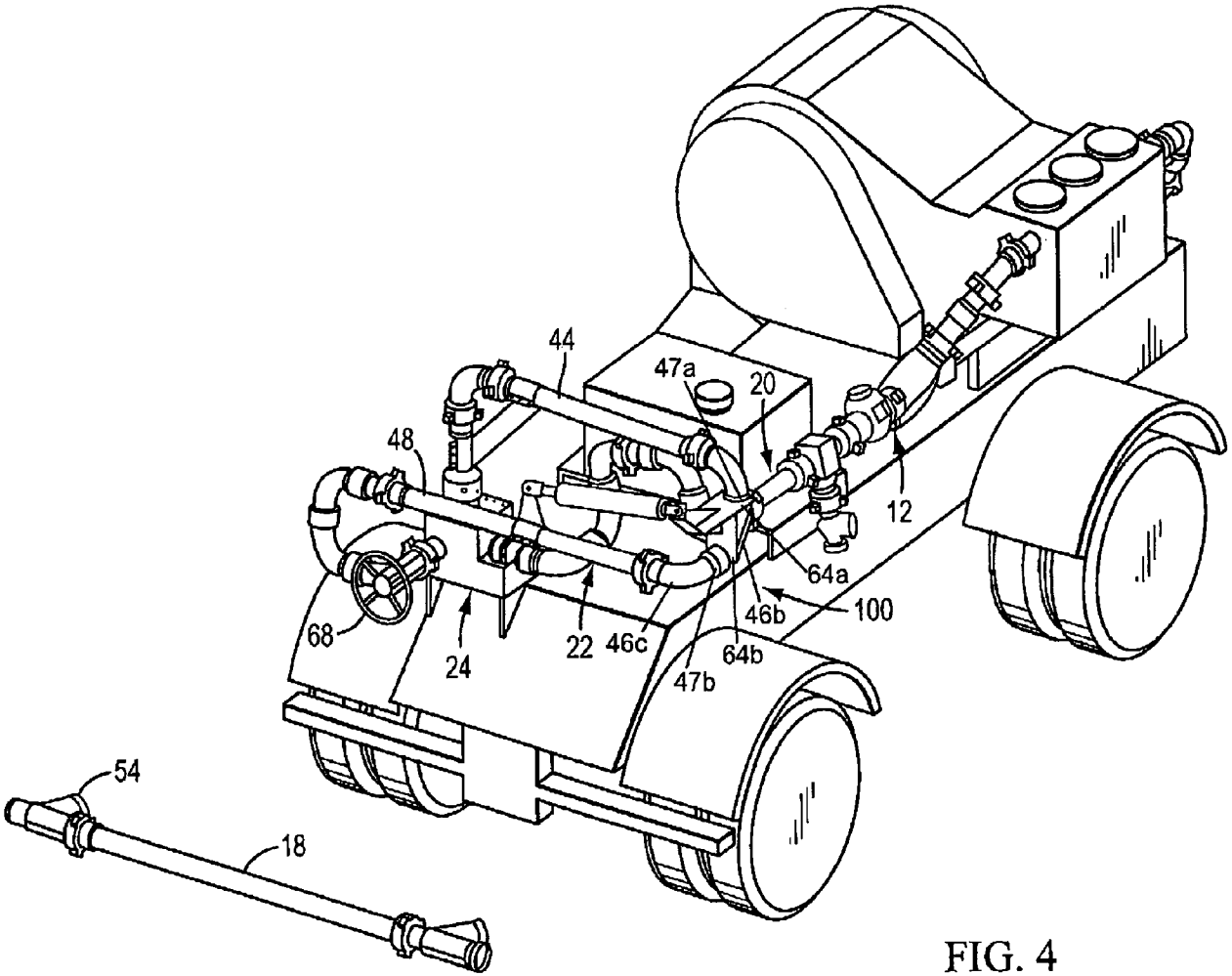
FIG. 4 is a perspective view of a second embodiment of the discharge arm assembly of the present invention.

Another embodiment of the invention is shown in FIG. 4. The discharge arm assembly of this embodiment, which is indicated generally by reference number 100, is similar to the discharge arm assembly 10 described above. However, in this embodiment the discharge arm assembly 100 is configured such that the articulated arm 22 is oriented laterally across the rear end of the trailer 16 in its stowed position. In addition, the base unit 24 is shorter than in the previous embodiment since the second pipe 44 of the articulated arm 22 does not need to clear any equipment on the trailer. Also, the discharge arm assembly 100 may be provided with a hand wheel 68 mounted to the outlet swivel joint 50 which a person may use to guide the outlet swivel joint to the coupling 54 on the collection manifold 18.

It should be recognized that, while the present invention has been described in relation to the preferred embodiments thereof, those skilled in the art may develop a wide variation of structural and operational details without departing from the principles of the invention. For example, the various elements shown in the different embodiments may be combined in a manner not illustrated above. Therefore, the appended claims are to be construed to cover all equivalents falling within the true scope and spirit of the invention.

What is claimed is:

1. A discharge arm assembly for a truck or trailer-mounted pumping unit which comprises:

a base unit which includes a base conduit that is rigidly secured to the truck or trailer and a swivel arm that is rotatable about a generally vertical axis;

a jumper line which is connected between an outlet of the pumping unit and the base conduit, an articulated arm which comprises a first generally straight pipe, a first swivel joint that is connected to the distal end of the first pipe, a second generally straight pipe that is connected to the distal end of the fist swivel joint, a second swivel joint that is connected to the distal end of the second pipe, and an outlet coupling that is connected to the distal end of the second swivel joint;

a generally 90° elbow which is connected to the swivel arm by a first threaded coupling and to the first pipe by a second threaded coupling; and a brace member which extends between the swivel arm and the first pipe to thereby support the first pipe for movement in a generally horizontal plane, the brace member comprising a first clamp member which is bolted to the swivel arm and a second clamp member which is bolted to the first pipe;

wherein the brace member prevents the second threaded coupling from coming loose during use of the articulated arm while allowing the first pipe to be removed from the swivel arm for repair or replacement.

2. The discharge arm assembly of claim 1, wherein the base conduit is connected to a frame member which in turn is connected to the truck or trailer.

3. The discharge arm assembly of claim 1, further comprising means for balancing the second pipe as the second pipe moves in a generally vertical plane.

4. The discharge arm assembly of claim 3, wherein the balancing means comprises a balancing cylinder which is connected at the second pipe and the first swivel joint.

5. The discharge arm assembly of claim 1, wherein the jumper line comprises a third swivel joint which provides at least two degrees of freedom of movement between the pumping unit and the base conduit.

6. The discharge arm assembly of claim 5, wherein the jumper line further comprises a fourth swivel joint which is connected between the third swivel joint and the base conduit.

7. A discharge arm assembly for a truck or trailer-mounted pumping unit, the arm assembly comprising:

a first swivel joint which is secured to the truck or trailer and includes a vertically extending swivel arm that comprises a vertically oriented swivel axis, the first swivel joint being fluidly connected to the pumping unit;

a first generally straight pipe which is connected to the distal end of the swivel arm by a first generally 90° elbow, the first pipe being horizontally pivotable about the swivel axis;

a second generally straight pipe which is connected to the distal end of the first pipe by a second swivel joint, the second pipe being both horizontally and vertically pivotable relative to the first pipe; and a balancing cylinder which is connected at the second swivel joint and the second pipe;

wherein during deployment of the arm assembly the balancing cylinder supports the weight of the second pipe as the second pipe is pivoted relative to the first pipe;

wherein the second swivel joint comprises a second generally 90° elbow which is connected to the first pipe by a first threaded connection, a third generally 90° elbow which is connected to the second elbow by a first swivel connection, and a fourth generally 90° elbow which is connected to the third elbow by a second swivel connection and to the second pipe by a second threaded connection;

wherein the balancing cylinder comprises a first end which is pivotally connected to a first bracket that in turn is connected to the second swivel joint and a second end which is pivotally connected to a second bracket that in turn is connected to the second pipe; and wherein the first bracket comprises a first portion which is secured to the first swivel connection and a second portion which is secured to the third elbow.

8. The arm assembly of claim 7, wherein the first and second brackets are configured to maintain the balancing cylinder generally parallel to the second pipe.

9. The discharge arm assembly of claim 7, wherein the second bracket includes a clamp which is bolted to the second pipe and prevents the second threaded connection from coming loose during use of the articulated arm while allowing the second pipe to be disconnected from the second swivel joint for repair or replacement.

* * * * *